United States Patent [19]

Aarts

[11] Patent Number: 4,601,313

[45] Date of Patent: Jul. 22, 1986

[54] DEVICE FOR FIXING AN AUXILIARY MEMBER OR ACCESSORY UPON THE REED OF A SHUTTLELESS LOOM OR WEAVING MACHINE

[75] Inventor: Hubertus H. Aarts, Deurne, Netherlands

[73] Assignee: Rüti-te Strake B.V., Deurne, Netherlands

[21] Appl. No.: 622,017

[22] Filed: Jun. 18, 1984

[30] Foreign Application Priority Data

Jul. 11, 1983 [NL] Netherlands ..... 8302456

[51] Int. Cl.[4] ..... D03D 41/00

[52] U.S. Cl. ..... 139/194; 139/370.2

[58] Field of Search ..... 139/370.2, 194, 435, 139/188 R

[56] References Cited

U.S. PATENT DOCUMENTS

| | | | |
|---|---|---|---|
| 1,272,532 | 7/1918 | Robinson et al. | 139/194 |
| 3,880,198 | 4/1975 | Vermeulen | 139/194 |
| 4,465,110 | 8/1984 | Dekker | 139/194 |

*Primary Examiner*—Henry S. Jaudon
*Assistant Examiner*—S. Shongut
*Attorney, Agent, or Firm*—Werner W. Kleeman

[57] ABSTRACT

An auxiliary member or accessory serves to reduce or limit the length of a weaving reed for the purpose of adapting it to the desired weaving width, so that the same reed can be used for differing weaving widths. The auxiliary member or accessory can be a stretching device or a detection device for the inserted weft threads. A flange of the auxiliary member is inserted between two reed lamallae or dents and is fixed on the rear side of the read by means of a locking element.

8 Claims, 3 Drawing Figures

DEVICE FOR FIXING AN AUXILIARY MEMBER OR ACCESSORY UPON THE REED OF A SHUTTLELESS LOOM OR WEAVING MACHINE

BACKGROUND OF THE INVENTION

The present invention broadly relates to weaving machines or looms and, more specifically, pertains to a new and improved construction of a device or arrangement for fixing an auxiliary member or accessory to the reed of a shuttleless loom or weaving machine.

Generally speaking, the device of the present invention serves to adjustably fix an auxiliary member or accessory in the weft direction upon the reed of a shuttleless loom or weaving machine. Under the term "shuttleless loom or weaving machine" a weaving machine is to be understood which is of the type in which a transport or conveying tunnel for measured or pre-cut weft thread segments or lengths is formed at the reed. An air jet nozzle for inserting the weft thread lengths is situated at one end of the weaving or loom shed. At the other end of the weaving or loom shed, an auxiliary member or accessory is situated.

This auxiliary member or accessory comprises a device operating with an air current or jet for catching or picking up and drawing or stretching the inserted weft thread lengths or a device for detecting the presence of inserted weft threads, or a combination of such devices. The device comprises a reception or catch channel situated in the extension of an effective portion of the transport tunnel of the reed and is adjustably fixed in the weft direction against the beat-up side of the reed.

Such weaving machines are employed in cases in which various widths of fabric or cloth are to be woven on the machine. This means that the reed extends or protrudes beyond the fabric or cloth edge or selvedge over a variable length on the side of the reed remote from the weft conveyor or insertion device and that only the portion of the transport tunnel situated within the fabric width is effectively utilized. The device for stretching or detecting weft thread lengths, or both, is fixed at the protruding reed portion.

Examples of known weaving machines of this type are, for instance, those disclosed in the U.S. Pat. No. 3,880,198, granted Apr. 29, 1975 and the U.S. Pat. No. 3,901,286, granted Aug. 26, 1975. In these known examples, the displaceable fixation of the auxiliary member on the reed is effected by means of a mounting clamp. In one case the mounting clamp engages an upper support member or beam of the reed and in another case the lower edge of the reed.

SUMMARY OF THE INVENTION

Therefore, with the foregoing in mind, it is a primary object of the present invention to provide a new and improved construction of a device or arrangement for fixing an auxiliary member or accessory to the reed of a shuttleless loom or weaving machine which does not have associated with it the drawbacks and shortcomings of the prior art constructions.

Another and more specific object of the present invention aims at providing a new and improved construction of a device of the previously mentioned type which provides a new and improved means of fastening or fixation of the auxiliary member or accessory upon the reed and, in particular, which is better adapted to the inertial forces arising from the beat-up motions of the reed.

Yet a further significant object of the present invention aims at providing a new and improved construction of a device of the character described which is relatively simple in construction and design, extremely economical to manufacture, highly reliable in operation, and not readily subject to breakdown or malfunction.

Now in order to implement these and still further objects of the invention, which will become more readily apparent as the description proceeds, the device of the present invention is manifested by the features that the auxiliary member or accessory comprises a flange. This flange includes a flange portion protruding past the rear side of the reed. This flange protrudes between two adjacent reed lamellae or dents through the reed to the rear side thereof. The protruding flange portion is provided with an aperture or opening for inserting a latching or locking element which may be an eccentric or toggle-type locking element.

In other words, the auxiliary member or accessory is provided with a flange which extends between two adjacent reed lamellae or dents through to the rear side of the reed while the flange portion protruding from the rear side of the reed is provided with an opening for inserting a latching or locking element. In this manner, the weft stretching or pulling device, defining the auxiliary member or accessory, can be simply and practically tightened at the beat-up side of the protruding portion of the reed while the position of the auxiliary member or accessory is adjustable in relatively small increments corresponding to the thickness of a reed lamella i.e. the pitch thereof.

In a practical embodiment of the invention, the latching or locking element is formed by a pin having a central portion arranged in slightly eccentric relation to both end portions of the pin and engaging the protruding flange portion. When this pin is rotated after being inserted, the two pin ends act as eccentric or toggle cams along the rear side of the reed and the weft stretching or pulling device is pulled firmly against the beat-up side of the reed.

According to a further feature of the invention, fixable and removable support blocks or clamping collars are provided at the pin ends and have at least one flat land. This embodiment has the advantage that when tightening the weft stretching or pulling device against the beat-up side by rotating the pin, the pin ends acting as eccentric or toggle cams do not come (as the result of an unfavorable line contact) into (immediate) contact with the reed, but only through the flat-landed support blocks or clamp collars bearing with their flat lands against the rear side or face of the reed and thereby only lightly loading the individual reed lamellae or dents.

The air stream or jet responsible for stretching the weft thread lengths or segments to be inserted into the weaving or loom shed is preferably oriented in a manner described in the U.S. Pat. No. 4,096,889, granted June 27, 1978.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing of the drawings only enough of the structure of the device for adjustably fixing an auxiliary member or accessory in the weft direction upon the reed of a shuttleless loom or weaving machine has been illustrated therein as is needed to enable one skilled in the art to readily understand the underlying principles and concepts of this invention. Although in the previous description and also in what follows, the terms "air current" and "air stream" are employed, it will be understood that any other suitable flowing or fluid medium can be employed instead of air for transporting and stretching the weft thread segments or lengths sequentially inserted into the loom shed. The term "air" is therefore to be considered to have a very broad meaning.

Figure 1:
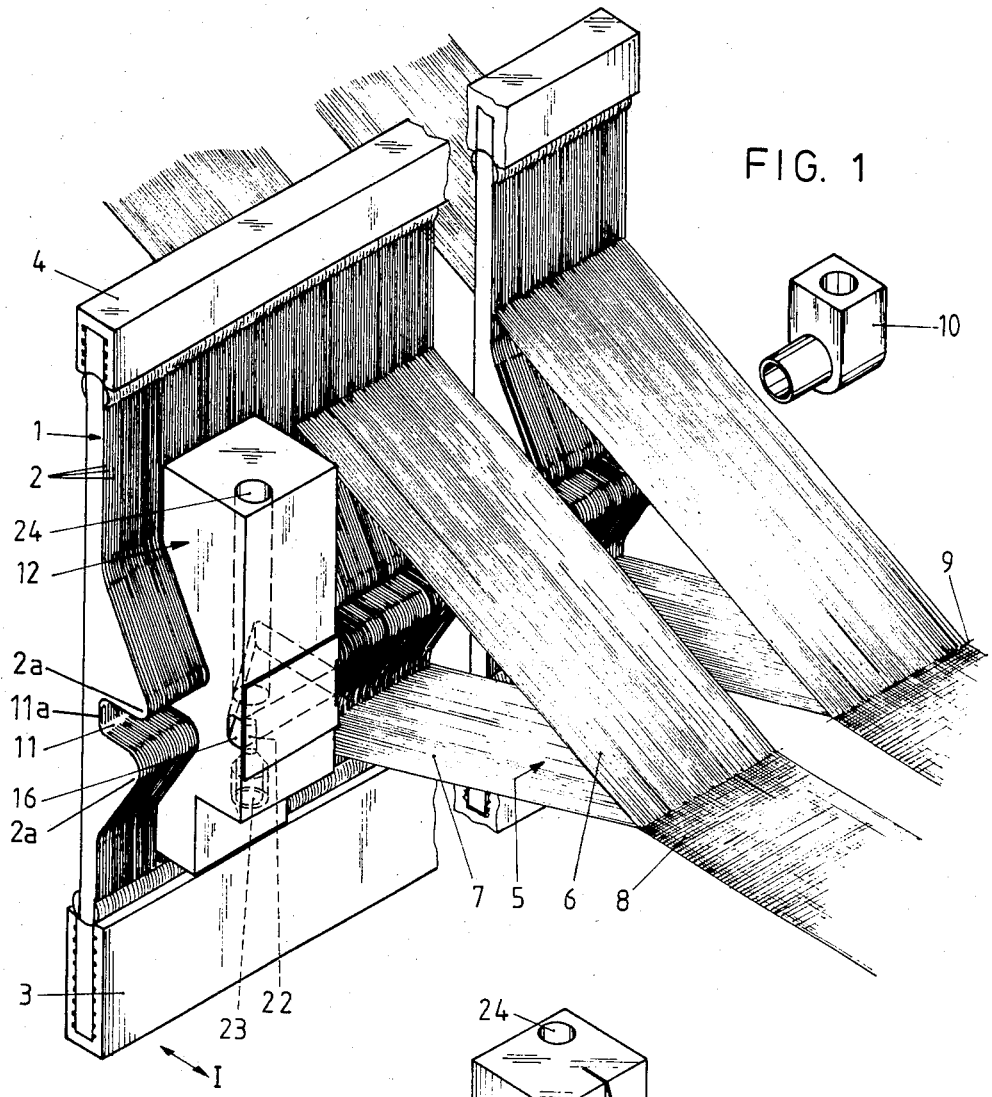
FIG. 1 shows a perspective view of a portion of the reed of a pneumatic weaving machine with a weft stretching device mounted thereupon in a manner according to the invention and constituting the auxiliary member or accessory.

The illustrated exemplary embodiment of the device or arrangement for adjustably fixing an auxiliary member or accessory in the weft direction upon the reed of a shuttleless loom or weaving machine will be understood to be employed for mounting an auxiliary member or accessory 12 constituting for instance a weft stretching or pulling device as can be seen in FIG. 1. In such FIG. 1, the reed is designated with the reference numeral 1 and is oscillatingly movable about a not particularly shown axis of rotation in the direction of the double-headed arrow I between the beat-up position of the reed and the withdrawn or retracted position thereof illustrated in such FIG. 1.

The actual reed 1 is formed in conventional manner by a series of reed lamellae or dents 2 having forwardly protruding tongues or parts 2*a* and adjacently arranged in the direction of the width of the weaving machine and which are anchored in a reed beam or frame member 3 at the lower side and in a reed rail or upper frame member 4 at the upper side.

The weaving or loom shed is designated with the reference numeral 5 and is defined by the upper warp 6, the lower warp 7 and the entirety of the reed lamellae 2. The already woven cloth or fabric is designated with the reference numeral 8 while the edge or fell thereof is designated with the reference numeral 9. The fell 9 is the line or edge of the fabric 8 being woven along which the reed 1 beats up a weft thread inserted into the weaving shed 5 each time the reed 1 assumes its effective beat-up position.

The insertion of a measured or pre-cut weft thread segment or length is performed by an air jet nozzle 10 arranged at one side of the weaving or loom shed 5. The transport of the weft thread segment or length inserted by the air jet nozzle 10 supplied with air (from a not particularly shown suitable source) in fact takes place through a weft transport or conveying tunnel 11 limited or defined by the entirety of cut-outs or recesses 11*a* in the reed lamellae 2. These cut-outs or recesses 11*a* are open in the direction of the beat-up line or fell 9. The transport of the weft thread through the weaving or loom shed 5 or through the reed tunnel 11 can be, especially for greater weaving widths, supported by intermediate or auxiliary air jet nozzles carried by the reed 1. These known auxiliary air jet nozzles are therefore not particularly shown in the drawings.

The weft stretching or pulling device 12 is mounted at the end portion of the reed remote from the air jet nozzle 10 and extending beyond the edge of the cloth or fabric 8 being woven. This weft stretching device 12 comprises a molded or formed body 12*a* whose side facing the reed 1 is formed to correspond to the profile of the reed lamellae or dents 2, as particulary shown in FIG. 2. The molded or formed body 12*a* of the weft stretching device 12 comprises a rib or ledge 13 which fits intimately into the portion of the reed tunnel 11 lying beyond the loom shed 5.

Figure 2:
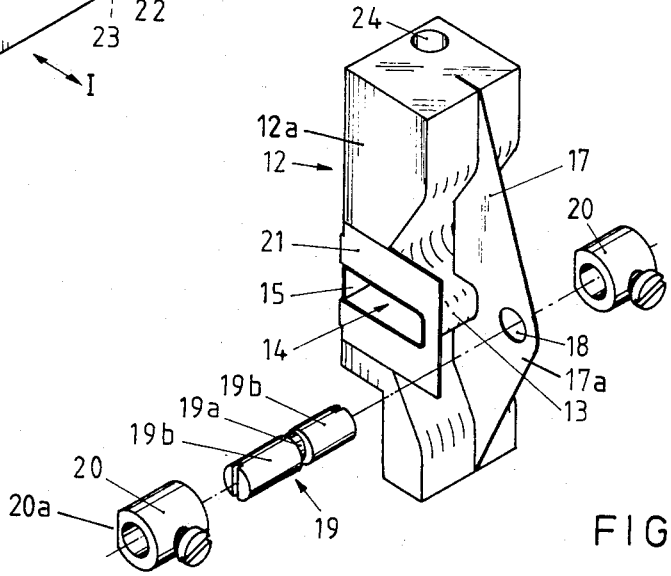
FIG. 2 shows a perspective view of the weft stretching device according to FIG. 1 viewed in the beat-up direction of the reed and seen with the latching or locking pin removed.

A reception or catch channel 14, which can best be seen in FIG. 2, is formed in the molded or formed body 12*a* of the weft stretching device 12 at the location of the rib 13. This reception or catch channel 14 is adjacent to the "effective" or "operative" portion of the reed tunnel 11 lying within the width of the woven cloth or fabric 8. The passage defined by the reception or catch channel 14 gradually reduces in the weft direction from the entry aperture 15, which can best be seen in FIG. 2. The cross-section of the entrance aperture or opening 15 is nearly as large as that of the transport tunnel 11. Therefore, the exit aperture or opening of the reception or catch channel and designated with the reference numeral 16 in FIG. 1 has a passage whose cross-section is only a fraction of the cross-section of the reed tunnel 11.

A flange or flange member 17 protruding from the molded or formed body 12*a* of the weft stretching device 12 serves for the fastening or fixation of the weft stretching device 12 on the profiled beat-up side of the reed. The protruding flange 17 passes between two adjacent reed lamellae or dents 2. In the mounted position, the flange 17 protrudes from the rear side of the reed 1 by a certain distance. An opening or aperture 18 is situated in this protruding flange portion 17*a*. This aperture or opening 18 can accommodate a latching or locking pin 19 whose diameter corresponds to the diameter of the opening or aperture 18.

The latching or locking pin 19 comprises a central region or portion 19*a* of somewhat smaller diameter which is situated eccentrically in relation to both end portions 19*b* thereof. In order that the molded or formed body 12*a* of the weft stretching device 12 can be fixed in the desired position on the beat-up side of the protruding reed portion, support blocks or clamp collars, designated with the reference numeral 20, and each having a flat land 20*a* are arranged on each end 19*b* of the pin 19 after insertion of such latching or locking pin 19. The support blocks or clamp collars 20 are arranged on the locking pin 19 such that their flat lands 20*a* bear against the rear side or face of the reed 1. The locking pin 19, while its central portion 19*a* lies within the opening or aperture 18 of the flange 17, is subsequently rotated such that the pin ends 19*b* function as eccentric or toggle cams within the support blocks or clamp collars 20 and press these support blocks or clamp collars 20 firmly against the rear side or face of the reed 1.

By means of a rotary motion in the opposite direction or sense and the removal of the support blocks or clamp collars 20, as well as a removal of the latching or locking pin 19, the weft stretching device 12 can be released in a simple manner.

In this manner it is even possible to quickly and practically move or adjust the weft stretching device 12 in connection with the weaving of different widths of cloth or fabric.

As shown in FIG. 2, a flange portion 21 is situated around the entry aperture 15 of the reception or catch channel 14. This flange portion 21 also fits between two adjacent reed lamellae or dents 2 and contributes to a good fixation of the weft stretching device 12.

The weft stretching device 12 gets its weft stretching or drawing action from an air stream or current which is oriented transversely to the reception or catch channel 14 in the vicinity of the entry aperture 15 and, in particular, approximately vertically through such reception or catch channel 14. A supply channel 22 is provided in the molded or formed body of the weft stretching device 12 which can be connected to a not particularly shown source of pressurized or compressed air at the position 23. The supply channel 22 opens into the lower wall of the reception or catch channel 14 in the vicinity of the exit aperture 16 directly opposite the catch or reception opening of a further mixing tube 24. The mixing tube 24 takes up the tip or leading end of the inserted weft thread segment or length under the influence of an air stream. This manner of weft stretching corresponds in principle to that of the weft stretching device according to the previously mentioned U.S. Pat. No. 4,096,889.

Figure 3:
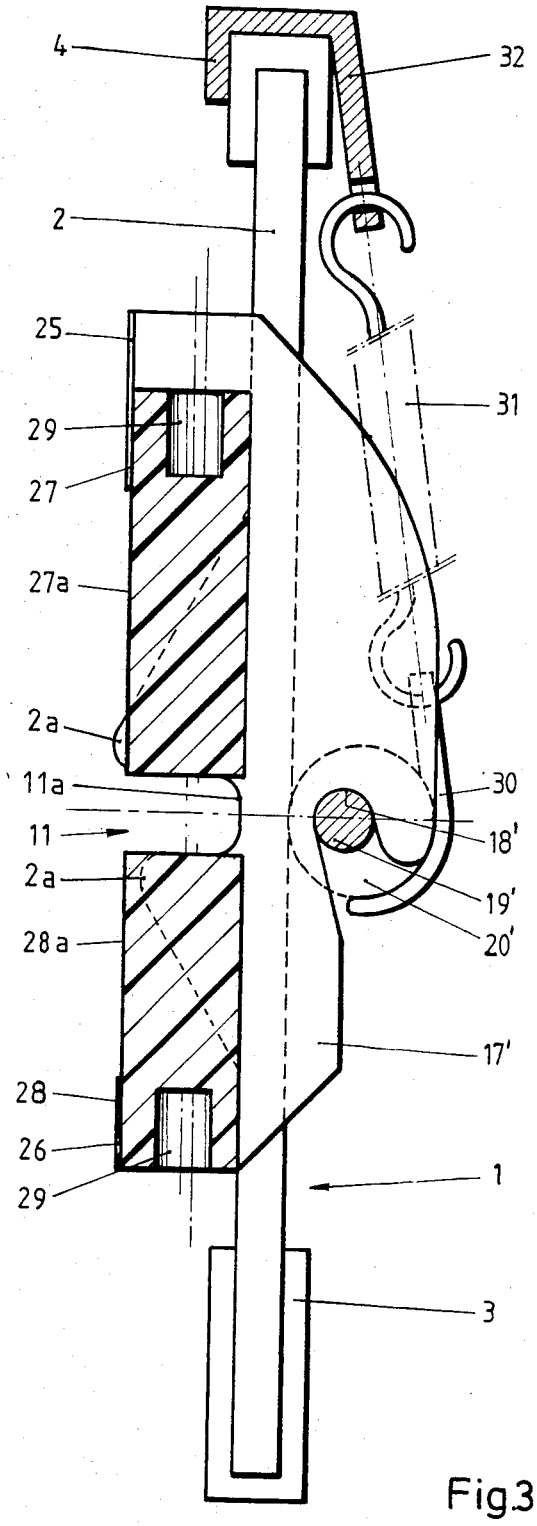
FIG. 3 shows a cross-section through the reed of a pneumatic weaving machine with a weft thread detection device mounted thereupon in a manner according to the invention according to a different embodiment.

In the embodiment shown in FIG. 3, a weft thread detection device is fastened or fixed upon the portion of the reed 1 extending beyond the edge of the cloth or fabric being woven, for instance at a location situated between the edge of the cloth or fabric and the weft stretching device 12. The manner of fastening or fixation shown in FIG. 3 differs from that shown in FIGS. 1 and 2 in that there are two fixation or fastening flanges 17′, each of which extends between two adjacent reed lamellae or dents 2. These fastening or fixation flanges 17′ (only one of which is visible in the cross-sectional view of FIG. 3) are interconnected on the front side (beat-up side) of the reed 1 by upper and lower connecting web members 25 and 26. The distance or spacing between the flanges 17′ is chosen such that upper and lower blocks 27 and 28 comprising a suitable air-permeable plastic material will fit between them. A space or void 29 for accommodating a transmitter or receiver of the weft thread detection device is formed in each block 27 and 28. The portion 27*a* of the upper block 27 which lies between the lower edge of the web 25 and the upper edge of tunnel 11 is, as viewed in a direction perpendicular to the plane of the drawing, narrowed or waisted down such that it passes between the forwardly protruding tongues or parts 2*a* of two adjacent reed lamellae 2. The same is true for the portion 28*a* of the lower block 28 lying between the upper edge of the web 26 and the lower edge of the tunnel 11.

In contrast to the manner of fastening or fixation according to FIGS. 1 and 2, the latching or locking pin 19′ and the component 20′ acting as eccentric or toggle cams are integrally formed and the opening or aperture 18′ is formed as an open-ended slot such that the latching or locking pin 19′ can be inserted from the underside. One end of an elastic or flexible element 30 is fastened to the portions 20′ arranged eccentrically in relation to the latching or locking pin 19′. The other end of the elastic or flexible element 30 is connected through a spring 31 or equivalent device to an element or hook 32 which hooks over the upper reed rail or frame member 4. The elastic or flexible element 30 tends to unwind or roll itself off the eccentric portions 20′ under the influence of the spring 31 which imparts a counterclockwise-directed torque to these portions. This torque moves the flanges 17′ to the right as seen in FIG. 3 and thereby tightens the blocks 27 and 28 against the forward side or face of the reed 2.

It will be understood that the manners of fastening here illustrated are also suited for fastening or fixing a combined weft thread stretching and detecting device.

While there are shown and described present preferred embodiments of the invention, it is to be distinctly understood that the invention is not limited thereto, but may be otherwise variously embodied and practiced within the scope of the following claims.

Accordingly, I claim:

1. A device for adjustably fixing an auxiliary member in the weft direction upon the reed of a shuttleless weaving machine, said reed having a rear side and comprising a plurality of reed lamellae defining dents of the reed, wherein:

said auxiliary member is provided with at least one flange;

said at least one flange including a flange portion protruding between an adjacent pair of said reed lamellae through the reed to said rear side thereof;

the providing flange portion being provided with an aperture on said rear side of the reed; and a locking element bearing against said rear side of the reed and insertable into said aperture and provided with means for tightening said auxiliary member against the reed.

2. A device for adjustably fixing an auxiliary member in the weft direction upon the reed of a shuttleless weaving machine, said reed having a rear side and comprising a plurality of reed lamellae defining dents of the reed, wherein:

said auxiliary member is provided with at least one flange;

said at least one flange including a flange portion protruding between an adjacent pair of said reed lamellae through the reed to said rear side thereof;

the protruding flange portion being provided with an aperture for inserting a locking element;

a locking element insertable into said aperture:

said locking element comprising a pin; and said pin having two end portions and a central portion situated in slightly eccentric relationship to both of said end portions for engaging said protruding flange portion.

3. The device as defined in claim 2, further including:

removable and fixable support blocks mounted at said end portions of said pin; and said support blocks being provided with at least one flat land.

4. A device for adjustably fixing an auxiliary member in the weft direction upon the read of a shuttleless weaving machine, said reed having a rear side and comprising a plurality of reed lamellae defining a dents of the reed, wherein:

said auxiliary member is provided with two flanges;

each flange including a flange portions protruding between an adjacent pair of said reed lamellae through the reed to said rear side thereof;

the protruding flange portion being provided with an aperture for inserting a locking element;

a locking element insertable into said aperture; and each flange having an open-ended slot defining said aperture for receiving said locking element.

5. The device as defined in claim 4, wherein:

said locking element comprises a pin.

6. The device as defined in claim 5, further including:

a hook element for engaging an upper edge of said reed;

spring means cooperating with the hook element;

a elastic element for connecting said pin defining said locking element to said spring means;

the elastic element exerting a torque upon the pin; and the spring means being connected with said hook element.

7. A device for adjustably fixing an auxiliary member in the weft direction upon the reed of a shuttleless weaving machine, said reed having a rear side and comprising a plurality of reed lamellae defining dents of the reed, wherein:

said auxiliary member is provided with at least one flange;

said at least one flange including a flange portion protruding between an adjacent pair of said reed lamellae through the reed to said rear side thereof;

the protruding flange portion being provided with an aperture for inserting a locking element;

a locking element insertable into said apertures; and the locking element defining a toggle-type locking element.

8. The device as defined in claim 1, wherein:

said at least one flange is essentially coextensive in length with said auxiliary member.

* * * * *

UNITED STATES PATENT OFFICE
CERTIFICATE OF CORRECTION

PATENT NO. : 4,601,313
DATED : July 22, 1986
INVENTOR(S) : HUBERTUS HENRICUS AARTS It is certified that error appears in the above-identified patent and that said Letters Patent are hereby corrected as shown below:

Column 6, line 34, after "the" please delete "providing" and insert --protruding--

Signed and Sealed this

Fourth Day of November, 1986

[SEAL]

*Attest:*

DONALD J. QUIGG

*Attesting Officer*

*Commissioner of Patents and Trademarks*